US007730743B2

(12) United States Patent
Hoover et al.

(10) Patent No.: US 7,730,743 B2
(45) Date of Patent: Jun. 8, 2010

(54) GEM SETTING HAVING GROOVED CHANNEL WALLS AND METHODS OF SETTING GEMS

(75) Inventors: Torrance D. Hoover, Midlothian, VA (US); Paula Faulkner, Richmond, VA (US); Stephen D. Stickley, Midlothian, VA (US); Frederick W. Klotz, Midlothian, VA (US)

(73) Assignee: Hoover & Strong, Inc., Richmond, VA (US)

( * ) Notice: Subject to any disclaimer, the term of this patent is extended or adjusted under 35 U.S.C. 154(b) by 549 days.

(21) Appl. No.: 11/729,828

(22) Filed: Mar. 30, 2007

(65) Prior Publication Data

US 2008/0235925 A1 Oct. 2, 2008

(51) Int. Cl.
*A44C 17/02* (2006.01)
*A44C 17/04* (2006.01)

(52) U.S. Cl. ..... 63/28; 63/15

(58) Field of Classification Search ..... None
See application file for complete search history.

(56) References Cited

U.S. PATENT DOCUMENTS

| | | | |
|---|---|---|---|
| 733,263 | A | 7/1903 | Nordt |
| 832,887 | A | 10/1906 | Wittstein |
| 873,156 | A | 12/1907 | Moe |
| 962,305 | A | 4/1909 | Buser |
| 1,056,414 | A | 3/1913 | Hexter |
| 1,121,296 | A | 12/1914 | Schmidt |
| 1,166,431 | A | 1/1916 | Capwell |
| 1,971,265 | A | 8/1934 | King |
| 2,003,950 | A | 6/1935 | Pejchar |
| 2,200,841 | A | 5/1940 | Gaertner |
| 2,377,222 | A | 5/1945 | Fruth |
| 2,749,597 | A | 6/1956 | Fus |
| 2,811,024 | A | 10/1957 | Thompson |
| 3,014,354 | A | 12/1961 | McCary |
| 4,258,458 | A | 3/1981 | Danna |
| 4,972,685 | A | 11/1990 | Poll |
| 5,218,839 | A | 6/1993 | Udko |
| 5,671,613 | A | 9/1997 | Hoover et al. |
| 6,619,378 | B1 | 9/2003 | Gavin |

OTHER PUBLICATIONS

Klotz, Fred "Setting Hoover & Strong Anniversary Bands," Setting Hoover & Strong Channeled Rings, (2002).

*Primary Examiner*—Jack W. Lavinder
(74) *Attorney, Agent, or Firm*—Oliff & Berridge, PLC

(57) ABSTRACT

A gem setting for gemstones includes a channel with walls having grooves for holding a portion of a gem girdle, such that when a gem having a crown is set into the channel, the upper portion of the groove extends over the crown of the gem. The upper part of the channel above the groove can be permanently bent or rolled over the crown of the gem to secure the gem in the ring channel. A method of setting a gem in the channel includes inserting the gem girdle in the grooves, without permanently bending the channel walls, until the gem is positioned within the channel such that if the gem and ring together are placed in an upside down position, the gem will not fall out of the channel. Next, the upper part of each channel is permanently bent over the crown of the gem, to thereby secure the gem in the channel.

20 Claims, 5 Drawing Sheets

GEM SETTING HAVING GROOVED CHANNEL WALLS AND METHODS OF SETTING GEMS

BACKGROUND

This invention relates to jewelry settings for gems, such as facet-cut diamonds.

Throughout history, gemstones such as diamonds have been cut and polished to form gems, and then set in rings, earrings and other objects to form jewelry. One cut that is currently popular for such gems is the round facet cut, or brilliant cut, shown in FIG. 1. This cut divides the gemstone 10 into an upper portion, known as the crown 11, and a lower portion, referred to as the pavilion 12. The circumference of the gem where the crown meets the pavilion is called the girdle 13. Another popular cut is the princess cut shown in FIGS. 2A and 2B. The princess cut gem 10' also includes a crown 11', a pavilion 12' and a girdle 13'.

A variety of gem settings have been employed to securely hold gems in jewelry. One of the most popular types of gem settings is the channel type setting. One advantage of the channel setting is that this type of setting allows the gem to be set into the surface of a ring. The gems can be set all the way around the ring circumference, as often is done with anniversary rings, or partially around the ring circumference, as is done with some wedding and other rings.

With this type of setting, the jeweler cuts notches in each of the channel walls. The notches correspond to the girdle of the gem. The jeweler then places the gem in the notches, so that the girdle of the gem rests in the notches. The portions of the walls above the notches are then bent over the crown of the gem with jeweler's pliers. With this type of setting, the notches must be carefully aligned on the channel walls so that they will hold the gem at a level position. Also, the shape of the notches must be carefully cut with hand tools, such as a motorized bur, to match the shape of the gem girdle. Thus, this type of setting can be used only by a skilled jeweler. In addition, much time is required to set all of the gemstones in the ring, particularly if the gemstones are provided around the entire circumference of the ring.

Some manufacturers have created a shelf in each of the channel walls. In this type of setting, the gem is rested only on the shape of the shelf. The remainder of the wall, particularly the portion of the wall extending above the shelf, is not used to help hold the gem in the channel. Thus, the gem will not be securely held in the setting, and turning the ring upside down (for example, to place gems around the entire circumference of the ring) will result in the gem falling out unless the gems are held in place, for example, with beeswax.

SUMMARY

Aspects of the invention address the disadvantages of the known techniques described above.

Aspects of the invention provide a gem setting including a channel in which a jeweler, or even an unskilled layman, may easily and quickly set a cut gem, such as a diamond.

According to aspects of the invention, a ready-made gem setting, such as a ring, provides a channel. The channel includes walls with a groove in each wall that safely maintains the gems at their desired positions in the setting until the walls of the ready-made channel can be tightened (that is, bent down over the gems) to securely hold each gem in the channel.

According to some embodiments, the ready-made channel includes a base and channel walls extending upward from the base. Each of the channel walls defines a preformed groove located in a groove plane, each groove facing inward toward the channel. According to preferred embodiments, each preformed groove is substantially identical to the other preformed groove. That is, the grooves are as similar to each other as can be achieved by the machining tolerances of the die striking, casting and machining process when a die strike, casting or machining method is used to form the grooves. Alternatively, the grooves will be as similar to each other as can be achieved by the machining tolerances of modern automated burring processes when an automated burring method is used to form the grooves.

According to preferred embodiments, each groove includes an upper portion and a lower portion that are shaped for holding a portion of a gem girdle therebetween, such that when a gem having a crown is set into the gem setting, the upper portion of the preformed groove extends over the crown of the gem. Thus, the gems are held in place once fully inserted into the channel, thereby allowing the jeweler or layman to insert the remaining gems without using any material (such as beeswax) to hold the gems in position within the channel. Each channel wall is divided by the groove into an upper part above the groove and a lower part below the groove, such that the upper part may be permanently bent over the crown of the gem to secure the gem in the channel.

According to some embodiments, the upper portion of the groove has a different radius of curvature than the lower portion of the groove.

According to some embodiments, the upper and lower portion of each groove is shaped to provide a profile corresponding to a profile of the girdle of a facet-cut gem.

According to some embodiments, the base includes a seat for each gem. The base can be drilled and countersunk, for example, to provide each seat.

According to preferred embodiments, each groove extends into the wall to a width of approximately 20% to 45% of the total width of the channel wall. According to some embodiments, each groove extends into the channel wall to a width of approximately 40% of the total width of the channel wall.

According to some embodiments, the upper portion of the groove has a different radius of curvature than the lower portion of the groove.

According to some embodiments, the gem setting is made to accommodate a princess cut gem. In some embodiments, the gem setting is made to accommodate a baguette cut gem.

According to some embodiments, the gem setting is a ring and the channel is provided on an entire circumference of the ring.

According to some embodiments, the gem setting is a ring and the channel is provided on only a portion of a circumference of the ring.

According to some embodiments, the setting is formed of gold alloy.

According to some embodiments, the setting is formed of platinum.

According to some embodiments, the setting is formed of palladium, and according to other embodiments it is formed of a silver alloy.

According to some aspects of the invention, methods are provided for making a ready-made gem setting with a channel having preformed grooves formed by machining or molding.

According to other aspects of the invention, methods are provided for making a ready-made gem setting having preformed channel grooves formed by burring with an automated burring device.

According to some embodiments of the invention, a gem having a crown and pavilion separated by a girdle is securely set in the channel of a setting by first inserting the girdle on one side of the gem into the groove on one wall of the channel. Next, a portion of the girdle on the opposite side of the gem is brought down into the groove on the other wall of the channel, until the girdle of the gem is positioned within the grooves of the channel such that if the gem and setting together are placed in an upside down position, the gem will not fall out of the channel. According to some embodiments, an audible sound occurs when the gem is brought down into the channel. The audible sound alerts the person that the gem being placed into the setting is now maintained at the desired position in the channel. Lastly, the top part of each channel wall is permanently bent over the crown of the gem, thereby securing the gem in the setting.

According to some embodiments of the invention, the upper part of each wall is bent by pushing the upper part against a tapered surface, a rolling wheel or by pushing the tapered surface against the upper part.

The grooves according to some embodiments may be formed by a die striking, casting or machining process. Alternatively, the channel ring according to some embodiments may be made by forming the grooves by burring the grooves into the walls of the channel with an automated burring device.

BRIEF DESCRIPTION OF THE DRAWINGS

Various exemplary embodiments of the invention are described in detail with reference to the following figures in which.

DETAILED DESCRIPTION OF EMBODIMENTS

Figure 1:
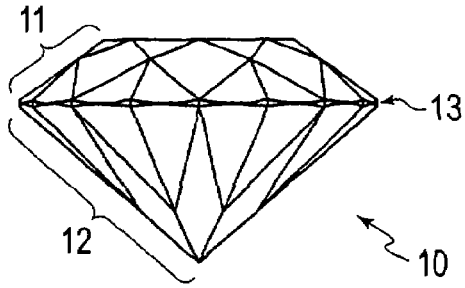
FIG. 1 is a side view of a gem having a round facet cut.
Figure 2A:
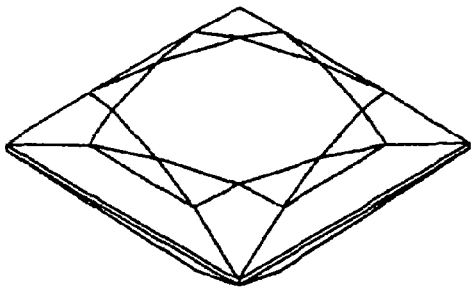
FIGS. 2A and 2B are a perspective view and a side view, respectively, of a gem having a princess cut.
Figure 2B:
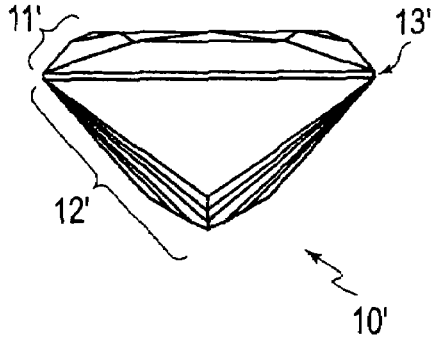
Figure 3A:
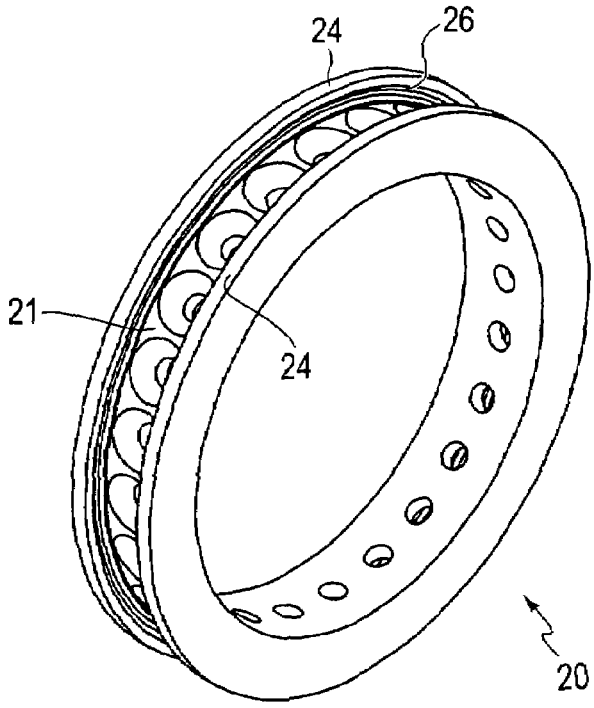
FIGS. 3A-C illustrate a perspective view and corresponding cross-sectional views of an exemplary ready-made gem setting that can be used with round facet cut gems.
Figure 3B:
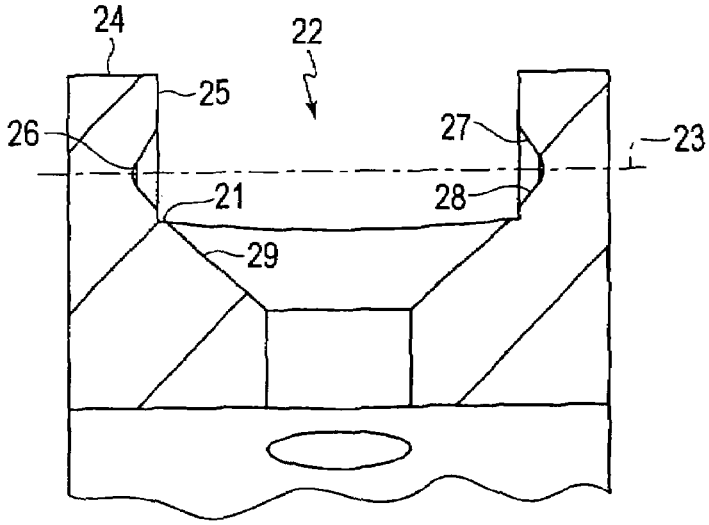
Figure 3C:
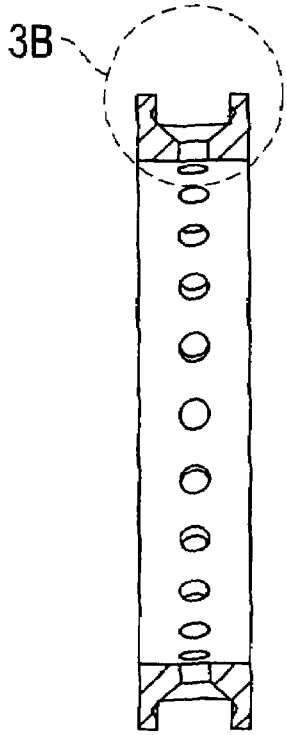

A first embodiment of the invention is shown in FIGS. 3A-3C. An exemplary ready-made gem setting 20 may be in the form of a ring. However, the setting 20 is not limited to a ring, and also may be in the form of earrings, necklaces, bracelets, pendants or other forms of jewelry. The exemplary setting 20 includes a channel 22 on an outer circumference of the setting 20. The channel 22 is defined by a base 21 and two walls 24 extending in a direction orthogonally outward from the base 21. The height of the walls 24 may vary according to the type and size of gem to be set in the setting, but should at least extend to a height that is taller than the crown 11 of the gem 10. This is so the upper part 25 of the walls 24 of the channel 22 can be bent down over the girdle 13 of each gem 10 to securely hold each gem 10 in the channel 22.

A concave groove 26 is disposed on an inner surface of each wall 24 so as to face the middle of the channel 22. The groove 26 of each wall is disposed in a groove plane 23 so that the opposing groove 26 is at the same height on each wall 24. Each groove 26 is comprised of a curved upper portion 27 and a curved lower portion 28. Alternatively, each groove 26 may be comprised of a v-shaped profile or a profile in which the upper portion 27 and the lower portion 28 intersect at an angle. The upper portion 27 and the lower portion 28 hold a portion of the gem girdle 13 therebetween. When a gem 10 is set into the channel, the upper portion 27 of each groove 26 extends over the crown 11 of the gem 10 by a small amount that is sufficient to hold the gem 10 in the setting 20 such that, if the gem 10 and channel 22 together are placed in an upside-down position, the gem 10 will not fall out of the channel 22. Thus, the gem 10 is held in place once it is fully inserted into the channel 22, thereby allowing the jeweler or layman to insert remaining gems without using any material (such as beeswax) to hold the gems in position within the channel 22. According to some embodiments, an audible sound (click) is provided when each gem 10 is pushed into position (that is, when the gem girdle 13 is held by the grooves 26).

The grooves 26 of each wall 24 are substantially identical. That is, the grooves 26 are as similar to each other as can be achieved by the machining tolerances of the die striking, casting and machining process when a die strike, casting or machining method is used to form the grooves 26. Alternatively, the grooves 26 may be as similar to each other as can be achieved by the machining tolerances of modern automated burring processes when an automated burring method is used to form the grooves. The upper portion 27 of each groove 26 may have the same or a different radius of curvature than the lower portion 28 of each groove 26, depending on the type of gem 10 to be set. In preferred embodiments, the upper portion 27 and the lower portion 28 of each groove 26 are shaped to provide a profile corresponding to a profile of the girdle 13 of a facet-cut gem. In some embodiments, the grooves 26 may be different from each other.

Each groove 26 is made to extend into the wall 24 to a preferable width of approximately 20% to 45% of the total width of the wall. In preferred embodiments, each groove 26 is made to extend into the wall 24 to a width of about 40% of the total width of the wall.

The channel 22 includes a base 21. The base 21 includes a seat 29 for each gem. The base 21 may be drilled and countersunk to provide the seats 29. The setting 20 may be formed of gold alloy. Alternatively, the setting 20 may be formed of platinum, palladium, or a silver alloy. However, the setting 20 may be formed of any material commonly used to form jewelry. As noted above, the channel 22, walls 24 and grooves 26 may be structured so that an audible sound is produced when each gem 10 is positioned within the channel, signaling to the jeweler or layman that the gem 10 being placed into the setting 20 is now maintained at the desired position in the channel 22.

In some embodiments, the gem setting 20 may be in the form of a ring. In such embodiments, the channel 22 may be provided on an entire outer circumference of the ring. Thus, gems 10 may be provided along the entire circumference of the ring. Alternatively, the channel 22 may be provided on only a portion of a circumference of the ring, so as to set gems on only a portion of the circumference of the ring. The embodiment of FIGS. 3A-3C is for use with round facet cut gems.

Figure 4A:
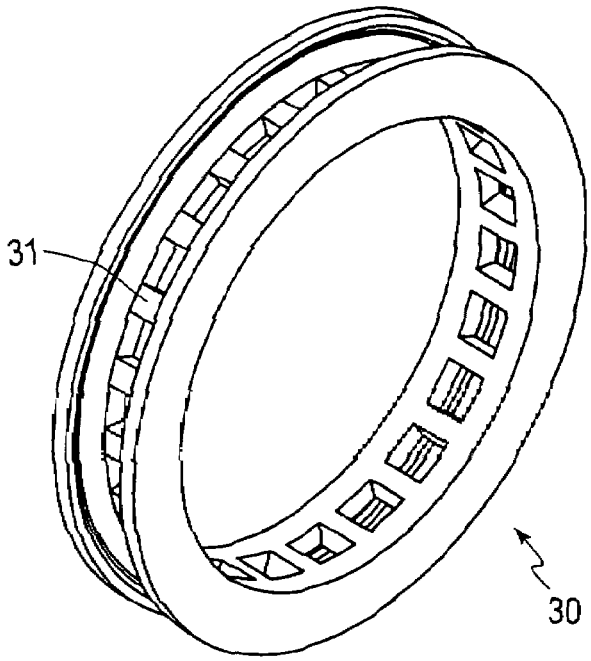
FIGS. 4A-C illustrate a perspective view and corresponding cross-sectional views of an exemplary ready-made gem setting that can be used with princess cut gems.
Figure 4B:
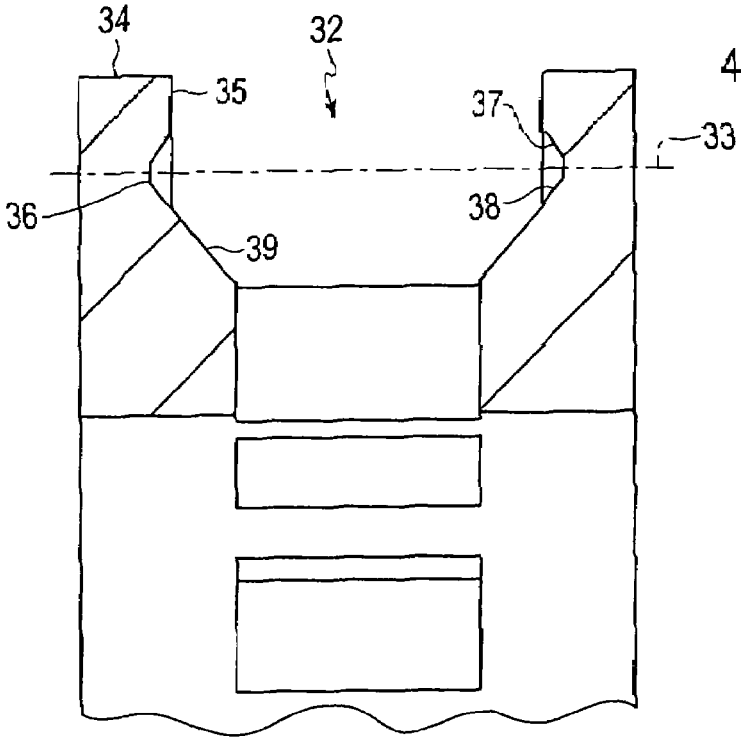
Figure 4C:
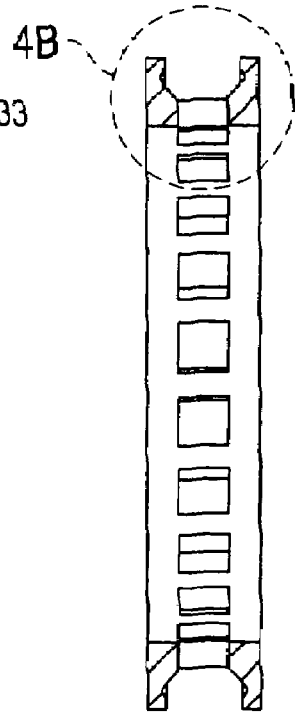

FIGS. 4A-4C illustrate a second embodiment of a ready-made setting 30. The second embodiment includes a channel 32, a groove plane 33, and two walls 34 each including a groove 36 comprised of an upper portion 37 and a lower portion 38. The second embodiment may incorporate all of the features and alternatives of the first embodiment described above. In the second embodiment, the channel 32, upper portion 37 and lower portion 38 of the groove 36, base 31 and seat 39 are formed to accommodate a princess cut gem.

Alternatively, the channel 32, upper portion 37 and lower portion 38 of the groove 36, base 31 and seat 39 may be formed to accommodate a baguette cut gem.

Figure 5A:
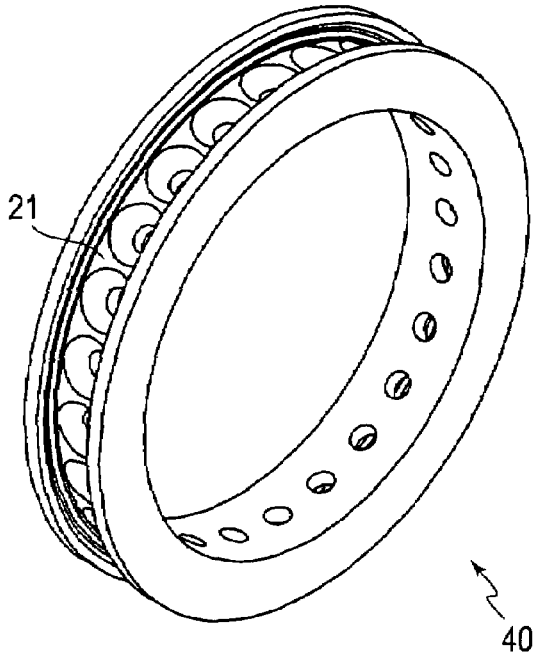
FIGS. 5A-C illustrate a perspective view and corresponding cross-sectional views of an exemplary ready-made gem setting that can be used with baguette cut gems.
Figure 5B:
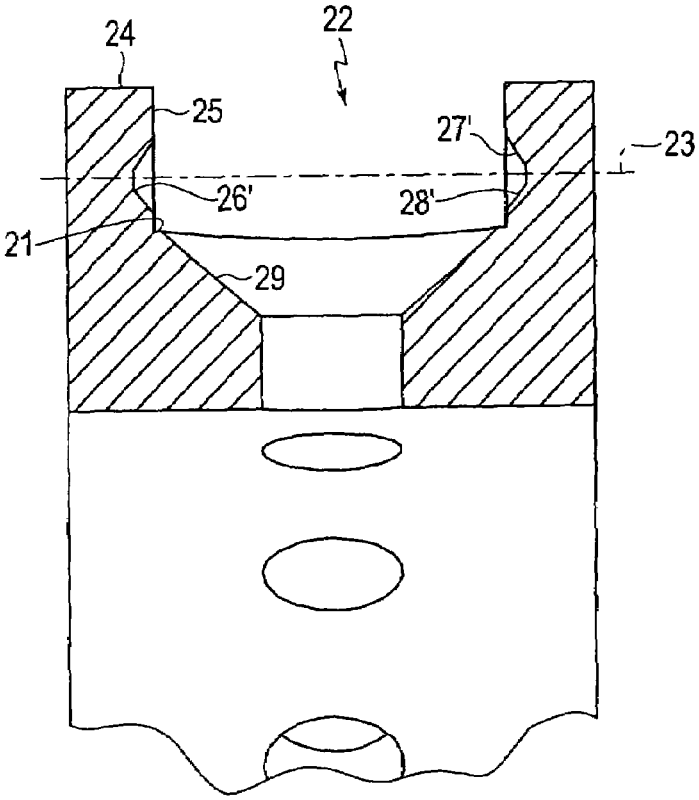
Figure 5C:
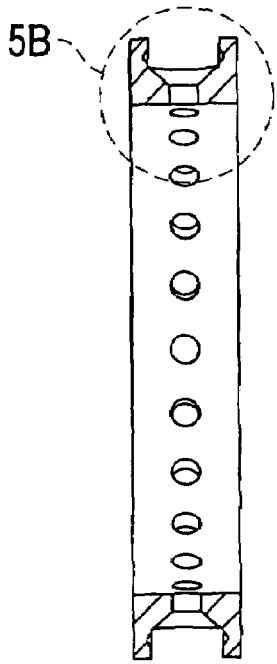

FIGS. 5A-5C illustrate a third embodiment of a ready-made setting 40. The third embodiment is a variation of the first embodiment described above, and may incorporate all of the features and alternatives of the first embodiment. In the third embodiment, upper portion 27' and lower portion 28' of the groove 26' are shaped to provide a profile that matches the profile of the girdle 13 of any particular cut gem.

In all embodiments described above, the settings including the preformed grooves 26 may be formed by a die striking, casting, machining, or a molding process. Alternatively, the grooves 26 may be formed by burring the grooves 26 into the walls 24 of the channel 22 with an automated burring device. Also, the grooves 26 need not be continuous, but could be discontinuous such that grooved portions are provided for each gem seat 29.

Figure 6:
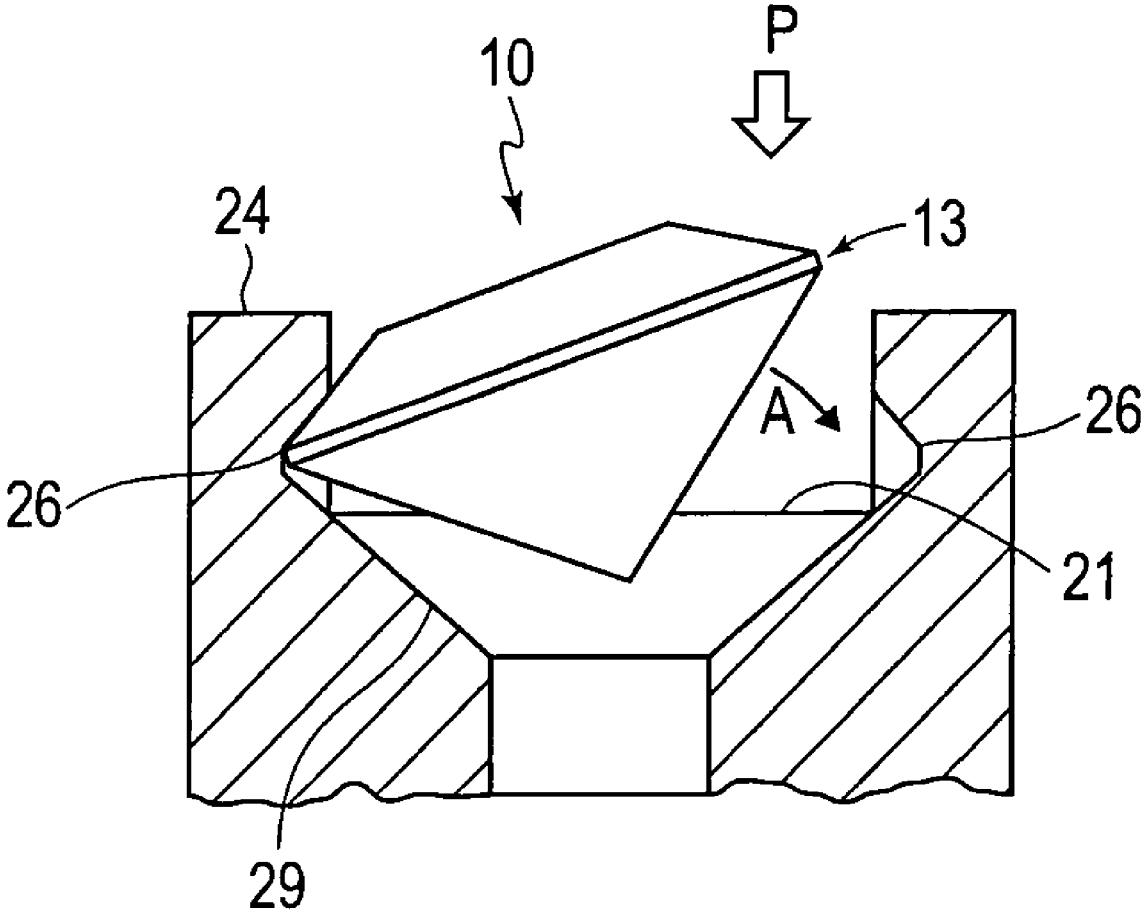
FIG. 6 illustrates an exemplary method of setting a gem in a ready-made setting.

Methods of securely setting gems 10 in the ready-made setting 20 are as follows. The methods may be used with any of the variations and alternatives of the setting 20, as well as with the settings 30 and 40 of the second and third embodiments. First, the setting 20 is provided. As shown in FIG. 6, the girdle 13 on one side of the gem 10 is then inserted into the groove 26 of one wall 24 such that a horizontal plane of the girdle 13 is at an angle with respect to the base 21 of the setting 20. Next, the girdle 13 on the opposite side of the gem 10 is rotated (indicated by arrow A) toward the groove 26 of the other wall 24. Pressure P is then applied to the gem 10 to insert the girdle 13 into the groove 26 of the other wall 24 preferably without permanently bending the wall 24, until the girdle 13 of the gem 10 is positioned within each groove 26 of the walls 24 of channel 22. The walls 24 are resilient enough such that they move back to their original position. That is, the walls 24 are resilient such that they are not permanently bent when flexed outward by the gem 10, but move to regain their original shape. At this stage, if the gem 10 and channel 22 together are placed in an upside down position, the gem will not fall out of the channel 22. The same steps are repeated for each gem 10 that is to be set into the setting 20. Finally, an upper part 25 of each wall is permanently bent over the crown 11 of each gem 10, thereby securing the gems 10 in the channel 22.

The upper part 25 of each wall 24 may be bent by pushing the upper part 25 against a tapered surface, a rolling wheel or pushing the tapered surface against the upper part 25.

In some embodiments, an audible sound occurs when each gem 10 is positioned within the channel 22 to alert the jeweler or layman that the gem 10 placed into the setting 20 is now maintained at the desired position in the channel 22.

While exemplary embodiments have been described, these embodiments should be viewed as illustrative, and not limiting. It will be appreciated that various of the above-disclosed and other features and functions, or alternatives thereof, may be desirably combined into many other different jewelry settings. Also, various presently unforeseen or unanticipated alternatives, modifications, variations or improvements therein may be subsequently made by those skilled in the art and are also intended to be encompassed.

What is claimed is:

1. A ready-made gem setting for holding gems having a crown, a pavilion, and a girdle, the gem setting comprising:

a base; and two walls that extend outward from the base by a distance so as to extend beyond the crown of the gems, the walls defining a channel between the walls, wherein each of the walls includes a concave groove in a groove plane, each groove facing toward the channel and including a curved upper portion and a curved lower portion, or an angled v-shaped profile, for holding a portion of the gem girdle, such that when a gem including a crown is set into the channel, the upper portion of each groove extends over the crown of the gem to hold the gem in the setting such that, if the gem and channel together are placed in an upside down position, the gem will not fall out of the channel, and the upper portion of the groove has a different radius of curvature than the lower portion of the groove.

2. The gem setting according to claim 1, wherein the grooves of each wall are substantially identical.

3. The gem setting according to claim 1, wherein each groove extends into its corresponding wall to a width of approximately 20% to 45% of the total width of the wall.

4. The gem setting according to claim 1, wherein the grooves are shaped to accommodate a princess cut gem.

5. The gem setting according to claim 1, wherein each groove is shaped to accommodate a baguette cut gem.

6. The gem setting according to claim 1, wherein the base includes a seat for each gem.

7. The gem setting according to claim 1, wherein the setting is provided in a ring and the channel is provided on an entire circumference of the ring.

8. The gem setting according to claim 1, wherein the setting is provided in a ring and the channel is provided on at least a portion of a circumference of the ring.

9. The gem setting according to claim 1, wherein the upper and lower portion of each groove is shaped to provide a profile corresponding to a profile of the girdle of a facet-cut gem.

10. The gem setting according to claim 1, wherein the setting is formed of at least one of gold alloy, platinum, palladium, and a silver alloy.

11. The gem setting according to claim 1, wherein an audible sound is produced when each gem is positioned within the channel.

12. A method of setting a gem including a crown, a pavilion, and a girdle in a gem setting, the gem setting comprising: (i) a base; and (ii) two walls that extend outward from the base by a distance so as to extend beyond the crown of the gems, the walls defining a channel between the walls, wherein each of the walls includes a concave groove in a groove plane, each groove facing toward the channel and including a curved upper portion and a curved lower portion, or an angled v-shaped profile, for holding a portion of the gem girdle, such that when a gem including a crown is set into the channel, the upper portion of each groove extends over the crown of the gem to hold the gem in the setting such that, if the gem and channel together are placed in an upside down position, the gem will not fall out of the channel, the method comprising:

providing the setting:

inserting the girdle on one side of the gem into the groove of one wall such that a horizontal plane of the girdle is at an angle with respect to the base of the setting;

rotating the gem so that the girdle on an opposite side of the gem moves toward the groove of the other wall;

applying pressure to the gem to insert the girdle on the opposite side of the gem into the groove of the other wall until the girdle is positioned within the groove such that, if the gem and channel together are placed in an upside down position, the gem will not fall out of the channel; and permanently bending an upper part of each wall over the crown of the gem, thereby securing the gem in the channel.

13. The method of setting a gem according to claim 12, wherein the upper part of each wall is bent by at least one of pushing the upper part against a tapered surface, a rolling wheel and pushing the tapered surface against the upper part.

14. The method of setting a gem according to claim 12, wherein an audible sound is produced when the gem is positioned within the channel.

15. A ready-made gem setting for holding gems having a crown, a pavilion, and a girdle, the gem setting comprising:

an annular member having a radially outward-facing surface defining a base; and two walls that extend outward from the base by a distance so as to extend beyond the crown of the gems, the walls defining a channel between the walls, the channel extending at least partially around a circumference of the base, the base including a plurality of seats located in the channel and corresponding in number to a number of the gems that are to be held in the gem setting, wherein each of the walls includes a concave groove in a groove plane, each groove facing toward the channel and including a curved upper portion and a curved lower portion, or an angled v-shaped profile, for holding a portion of the gem girdle, such that when a gem including a crown is set into the channel, the upper portion of each groove extends over the crown of the gem to hold the gem in the setting such that, if the gem and channel together are placed in an upside down position, the gem will not fall out of the channel, and a lower portion of the gem is disposed in one of the seats.

16. The gem setting according to claim 15, wherein each of the seats includes an opening that extends through the base.

17. The gem setting according to claim 15, wherein the setting is provided in a ring and the channel is provided on an entire circumference of the ring.

18. The gem setting according to claim 15, wherein an audible sound is produced when each gem is positioned within the channel.

19. The gem setting according to claim 15, wherein the upper and lower portion of each groove is shaped to provide a profile corresponding to a profile of the gem.

20. A ready-made gem setting for holding gems having a crown, a pavilion, and a girdle, the gem setting comprising:

a base; and two walls that extend outward from the base by a distance so as to extend beyond the crown of the gems, the walls defining a channel between the walls, wherein each of the walls includes a concave groove in a groove plane, each groove facing toward the channel and including a curved upper portion and a curved lower portion, or an angled v-shaped profile, for holding a portion of the gem girdle, such that when a gem including a crown is set into the channel, the upper portion of each groove extends over the crown of the gem to hold the gem in the setting such that, if the gem and channel together are placed in an upside down position, the gem will not fall out of the channel, the base includes a seat for each gem, and the setting is provided in a ring and the channel is provided on at least a portion of a circumference of the ring.

* * * * *